US006202365B1

(12) United States Patent
Provitola

(10) Patent No.: US 6,202,365 B1
(45) Date of Patent: Mar. 20, 2001

(54) SUSPENDED DECK STRUCTURE

(76) Inventor: Anthony Italo Provitola, P.O. Box 2855, DeLand, FL (US) 32721-2855

( * ) Notice: Subject to any disclaimer, the term of this patent is extended or adjusted under 35 U.S.C. 154(b) by 0 days.

(21) Appl. No.: 09/310,708

(22) Filed: May 12, 1999

(51) Int. Cl.[7] ..... E04B 1/32
(52) U.S. Cl. ..... 52/80.1
(58) Field of Search ..... 52/80.1, 167.1, 52/167.2, 167.3, 167.5, 82, 148; 135/100; 14/18, 22; 211/113, 134, 133.1

(56) References Cited

U.S. PATENT DOCUMENTS

| | | | | |
|---|---|---|---|---|
| 3,464,217 | * | 9/1969 | Streit | 135/100 |
| 4,019,280 | * | 4/1977 | Summers | 47/45 |
| 4,688,360 | * | 8/1987 | Luong et al. | 52/166 |
| 4,838,292 | | 6/1989 | Allen . | |
| 4,838,293 | * | 6/1989 | Novak | 135/100 |
| 5,072,555 | * | 12/1991 | Geiger | 52/82 |
| 5,394,661 | | 3/1995 | Noble . | |
| 5,605,021 | | 2/1997 | Thommann . | |
| 5,771,642 | | 6/1998 | Lester . | |
| 5,836,331 | * | 11/1998 | Grahn | 135/94 |
| 5,875,589 | | 3/1999 | Lai . | |
| 6,026,614 | * | 2/2000 | Johnston | 52/82 |

* cited by examiner

*Primary Examiner*—Daniel P. Stodola
*Assistant Examiner*—Curtis A. Cohen

(57) ABSTRACT

A suspended deck structure is a framework from which a ceiling and/or floor deck is suspended, and which may be employed in single story and multi-story constructions. A suspended deck structure allows the interior floor and/or ceiling decks to move within the framework horizontally relative to the framework from which it is suspended to compensate for the effects of movement of the framework.

19 Claims, 7 Drawing Sheets

SUSPENDED DECK STRUCTURE

CROSS-REFERENCE TO RELATED APPLICATIONS

U.S. patent application Ser. Nos. 09/276,665 and 09/276,666; and U.S. Patent Application entitled Horizontal Arch filed May 10, 1999.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

The present invention is a suspended deck structure which allows for movement of floor and/or ceiling decks of constructions relative to their supporting framework. Such a structure may be employed in constructions having floor and/or ceiling decks for the support of persons, vehicles, furniture, equipment, etc; such as buildings, bridges, and towers. Suspended deck structures may also be employed in such constructions, mobile or immobile, that may be subjected to unwanted horizontal movement.

The most similar structure in prior art is the suspension bridge, in which a deck is suspended from tension elements hung between two towers, or in which a deck is cantilevered by tension elements attached to a single supporting tower. Suspension elements have also been used in tent structures, and for suspension of tiles and other ceiling surfaces from a roof /floor structural framework. However, none of these structures involve the suspension of floor and/or ceiling deck structures with tension elements within a structure from a framework. Otherwise, there does not appear to be any prior art that this invention builds upon except generally in the field of structural engineering, none of which directly addresses suspended decks.

The effect on the stories of a structure, such as a tower or building, caused by rapid lateral movement, such as occurs with wind forces and during earthquakes, may be addressed with the present invention. At least one "earthquake proof building" has been disclosed so-entitled in U.S. Pat. No. 5,605,021, which appears as a self-contained reinforced concrete vessel placed on the ground, and does not appear to have any significance as prior art except by its title. In contrast, and with respect to the issue of earth movement under a structure, the present invention can allow the interior decks of a structure to move relative to the framework of the structure from which it is suspended to compensate for the movement of the framework.

The present invention has elements that are covered generally by class 52, static structures, with consideration being given to subclasses 167.1+; and class 14, bridges.

BRIEF SUMMARY OF THE INVENTION

The present invention is a suspended deck structure which is a vertical load bearing framework from which a ceiling and/or floor deck is suspended. A suspended deck structure may be employed in constructions having floor and/or ceiling decks for the support of persons, vehicles, furniture, equipment, etc; such as buildings, bridges, and towers.

Suspended deck structures may also be employed in such constructions, mobile or immobile, that may be subjected to unwanted horizontal movement. The effect of movement of a structure resulting from wind forces or movement of earth under the foundation is also addressed with the present invention. The present invention allows the interior decks of a structure to move relative to the framework from which it is suspended to compensate for the effects of movement of the framework.

The preferred embodiments of the invention incorporate toroidal and torsion elements and structures.

BRIEF DESCRIPTION OF THE DRAWINGS

FIG. 1*a* is a perspective fragmentary view of the schematic of shock-absorber damping of the suspension of the floor decks within the framework shown in FIG. 1.

FIG. 1*b* is a perspective fragmentary view of the schematic of spring damping of the suspension of the floor decks within the framework shown in FIG. 1.

DETAILED DESCRIPTION OF THE INVENTION

Figure 1:
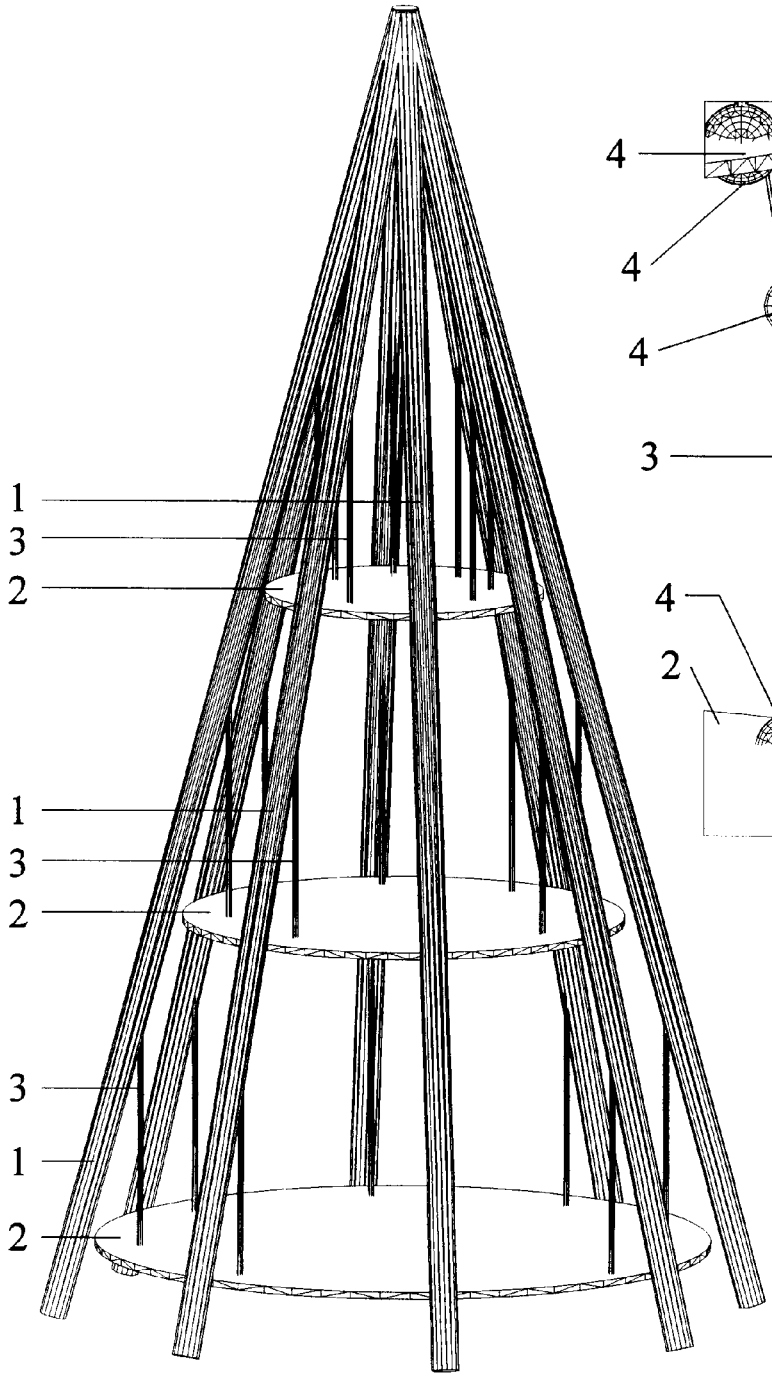
FIG. 1 is a perspective view of a suspended deck structure of a tower/building framework with suspended floor decks.
Figure 2:
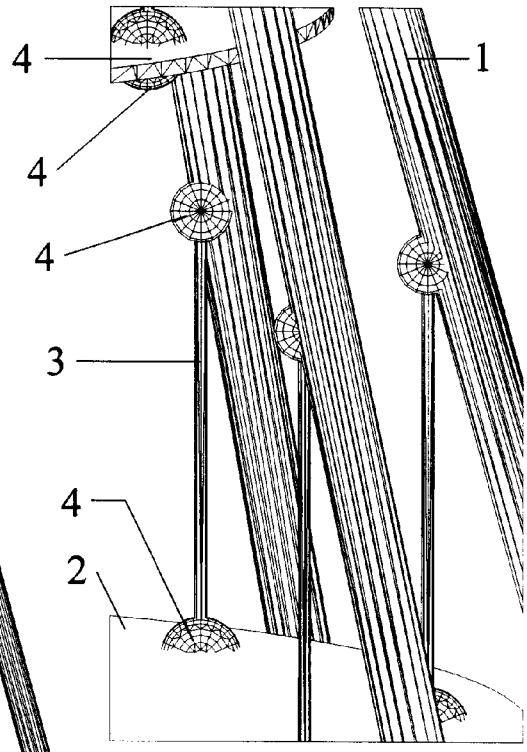
FIG. 2 is a perspective fragmentary view of the suspension of the floor decks within the framework shown in FIG. 1.

The present invention is a suspended deck structure an example of which is shown in FIG. 1, including a load bearing framework 1 for bearing a vertically downward load, and a ceiling and/or floor deck 2 suspended from the framework. Such a framework 1 may hereinafter be referred to simply as "framework", and a deck, whether floor or ceiling, with its own structure and surfacing, may be hereinafter referred to simply as "deck". Decks 2 are suspended from a framework 1 by suspension tension elements 3, such as cables or rods, which connect a deck 2 to a framework 1. The ceiling and/or floor deck 2 is thus suspended and is not otherwise in direct contact with the framework 1. However, intermediating devices, such as springs 13 or shock absorbers 14, may be placed between a deck and the framework from which it is suspended, as shown in FIGS. 1*a* and 1*b*. Such intermediating devices may be incorporated in or otherwise attached to the framework 1 and/or the deck 2. A suspended deck structure may be employed in single-story and multistory constructions having floor and/or ceiling decks 2 for the support of persons, vehicles, furniture, equipment, etc; such as buildings, bridges, and towers. Suspended deck structures may also be employed in other constructions, mobile or immobile, that may be subjected to unwanted horizontal movement.

The effect of unwanted horizontal movement of a structure resulting from wind forces or movement of earth under the foundation is also addressed with the present invention. The present invention allows the interior decks 2 of a structure to move relative to the framework 1 from which it is suspended to compensate for the effects of movement of the framework.

The example of a suspended deck structure shown in FIG. 1, is a conical multipodal framework of poles 1 which supports the suspension of three floor decks 2 within the volume bounded by the framework 1. The vertical suspending elements 3 can be rods, cables, or any adequate tension element or structure, and may be hereinafter referred to as suspending tension elements. The deck 2 spans the points of support between the suspending tension elements 3 by its own internal structure. The attachment of the suspending tension elements 3 to the deck may be accomplished by ball-joints or the like 4, shown diagrammatically in FIG. 2 as partial spherical shapes 4, which allow lateral swinging of suspended tension elements 3 and the connected deck 2 so that the deck 2 can move in any direction within the framework 1 while remaining parallel or nearly parallel to the plane of its original suspended position. The maintenance of the parallel or nearly parallel orientation of the suspended deck 2 is a result of a triangular pattern of attachment to the suspended deck 2 of three of the plurality of vertical suspending tension elements 3 employed, as shown in FIGS. 1–12.

The nature of the movement of a suspended deck is similar to that of a pendulum of the same length and mass. In the case of the suspended deck structure shown in FIG. 1, if the framework 1 were to be moved horizontally, the suspended deck 2 would not immediately respond to such movement, but remain relatively motionless relative to the original position of the framework 1, as would a pendulum. If the framework 1 rapidly returned to its original position, there would be little movement, if any, of the suspended deck 2. If the movement of the framework 1 came to rest at a distance from its original position which exceeded the original clearance between the suspended deck 2 with the framework 1 before any motion of the framework 1 began, the suspended deck 2 would be forced to move with the framework 1 by contact with the framework 1. If the movement of the framework 1 was oscillatory, the movement of the suspended deck 2 that followed would depend on whether the oscillatory movement of the framework 1 exceeded said original clearance of the suspended deck 2 with the framework 1, in which case the suspended deck 2 would be forced to move with the movement of the framework 1 by contact therewith; or whether the oscillatory movement of the framework 1 was of a frequency significantly less than the natural pendulum period of the suspended deck 2, in which case the suspended deck 2 would be caused to have oscillatory movement as well. In those instances when a suspended deck 2 is caused to move so as to make contact with the framework 1 or vice versa, such movement may be damped by the action of the aforementioned intermediating devices, such as springs 13 or shock absorbers 14, shown in FIGS. 1*a* and 1*b*, which would also buffer contact between the framework 1 and a suspended deck 2.

Figure 4:
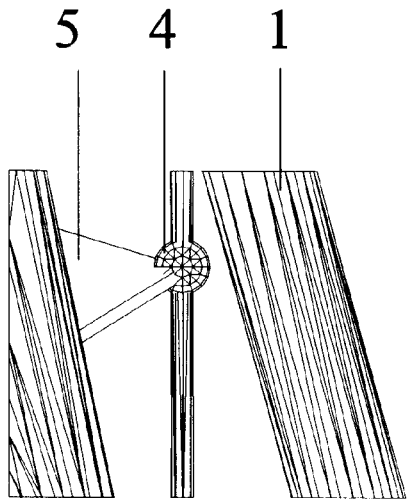
FIG. 4 is a perspective fragmentary view of the suspension of ceiling decks in the suspended deck structure shown in FIG. 3.
Figure 3:
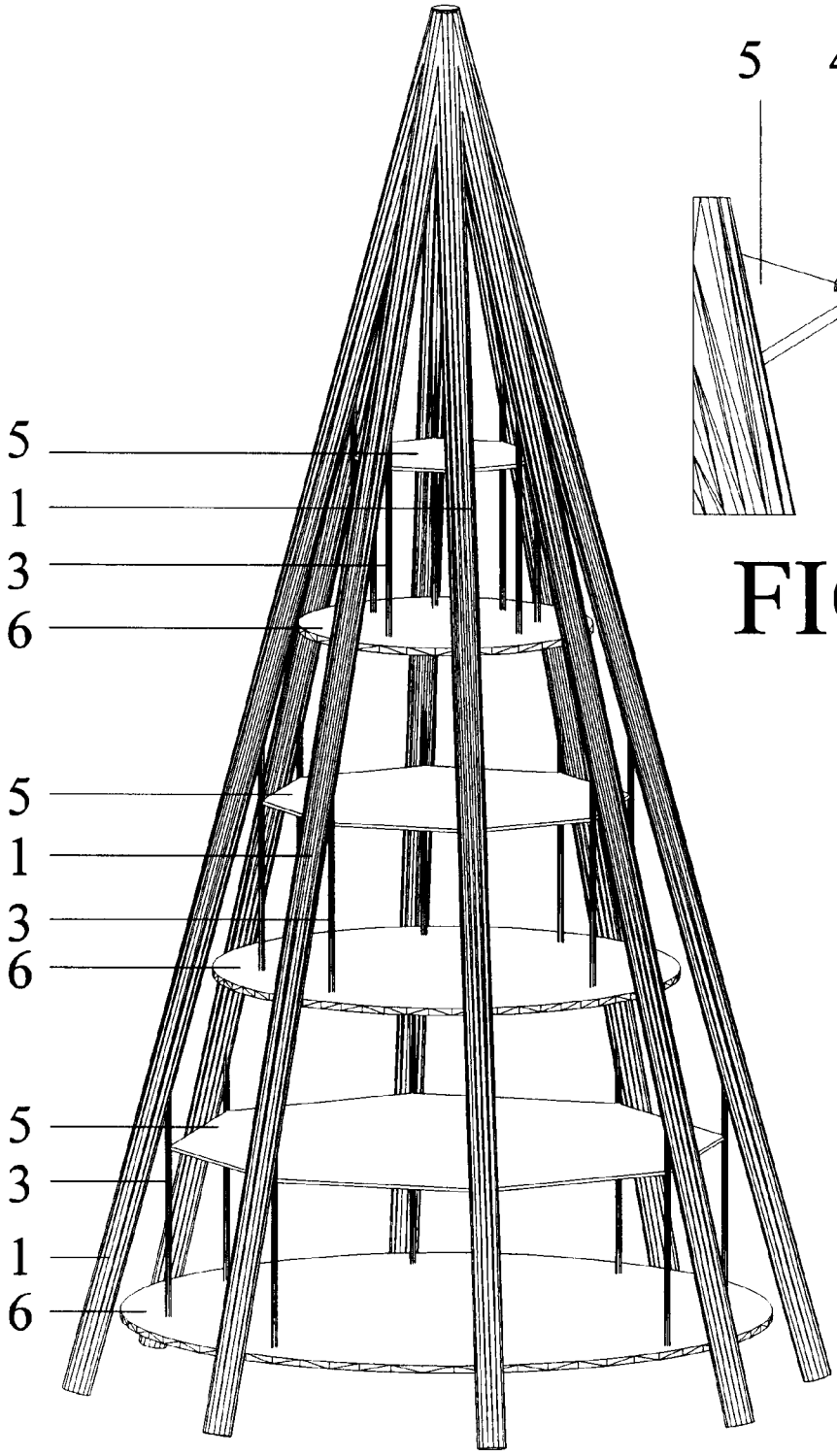
FIG. 3 is a perspective view of the suspended deck structure shown in FIG. 1 with suspended ceiling and floor decks.

A framework 1 may also support ceiling decks 5 as shown in FIG. 3, where the ceiling decks 5 are also suspended from the framework 5 by the same suspending tension elements 3 as suspend the floor decks 6. This may be accomplished as shown in FIG. 4 by the connection of the ceiling deck 5 to suspending tension elements 3 suspending the floor deck 6 by means of ball-joints 4, shown diagrammatically as partial spherical shapes 4. However, it is not necessary that the ceiling deck 5 be suspended from the same suspending tension element 3 as the suspended floor deck 6. Indeed, a floor deck 6 may be suspended from a ceiling deck 5 structure and vice versa, or both ceiling deck 5 and floor deck 6 independently suspended from the framework 1.

Figure 5:
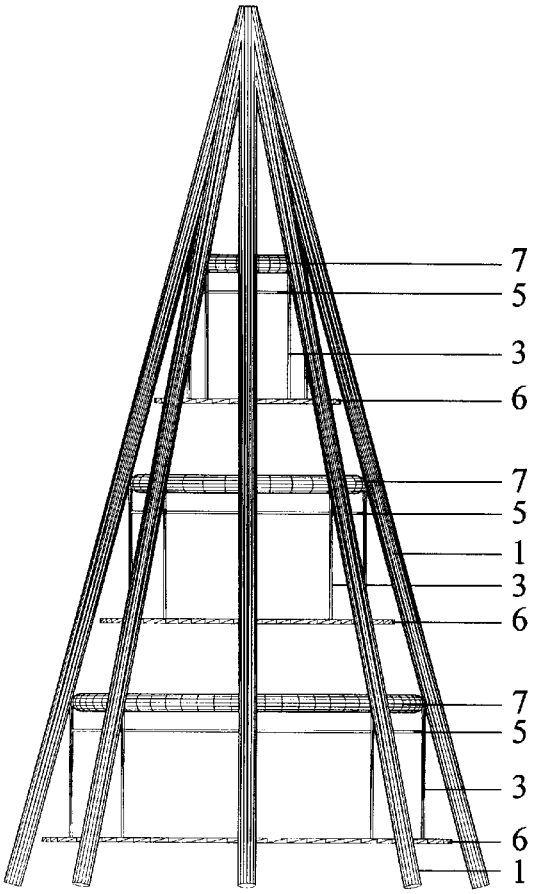
FIG. 5. is an elevation of the suspended deck structure as shown in FIG. 3 with reinforcement of the framework poles.
Figure 6:
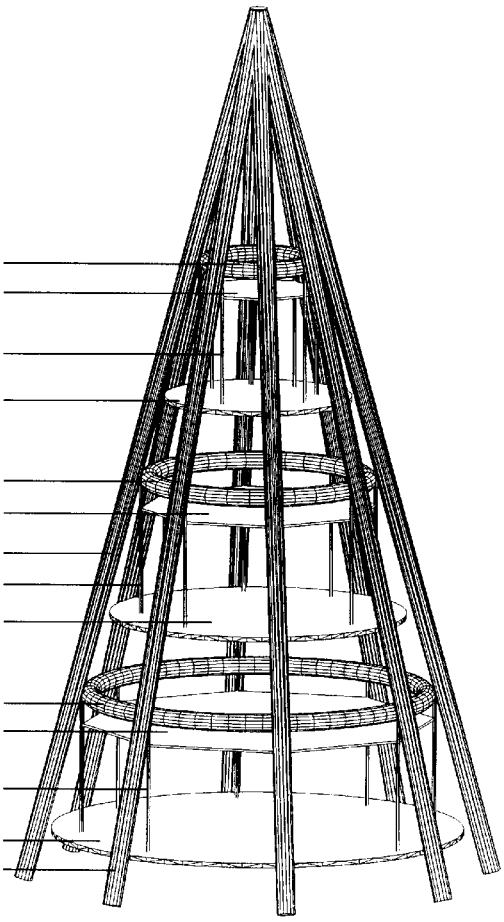
FIG. 6 is a perspective view of the suspended deck structure shown in FIG. 5.
Figure 7:
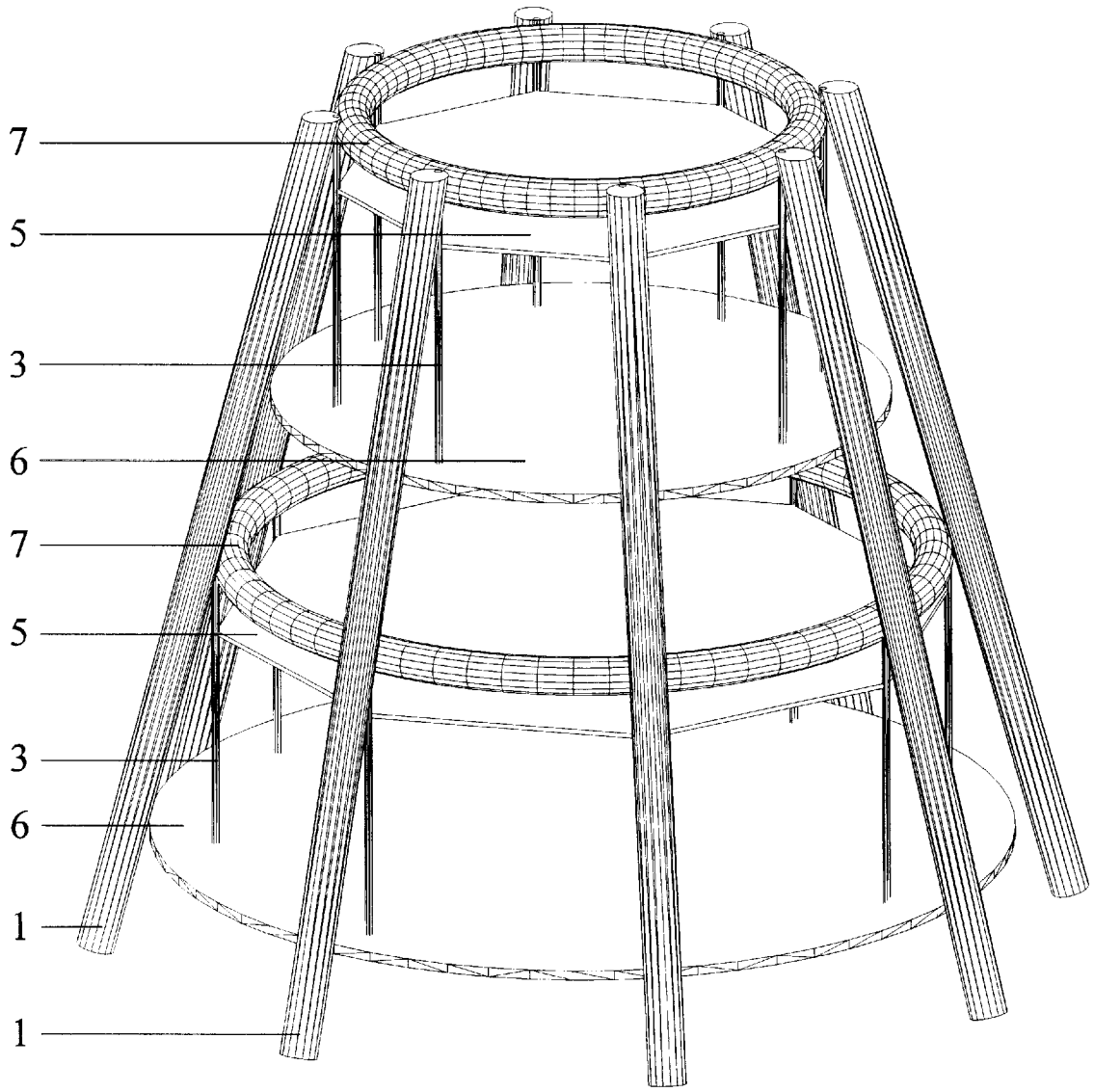
FIG. 7 is a perspective view of the suspended deck structure shown in FIG. 6 truncated to two stories.

For the type of structures in FIGS. 1–4 some form of reinforcement, such as the toroidal member 7 shown in FIGS. 5 and 6, may be included to prevent inward sag from flexion of the framework poles 1 under the vertical load of the deck suspensions. Such toroidal members 7 may also be fundamental to the framework 1, as shown in FIG. 7, where they are the principal connection and support of the framework poles 1.

Figure 8:
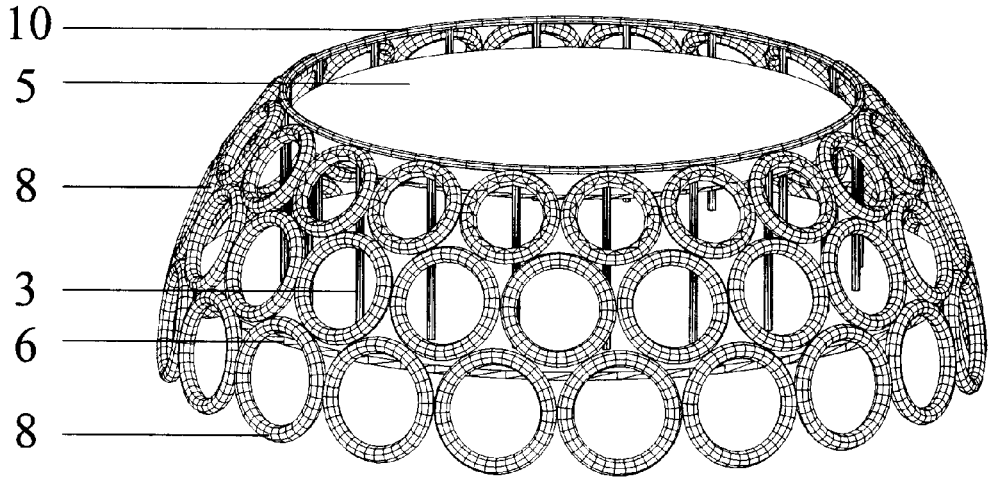
FIG. 8 is a perspective view of the suspended deck structure of a horizontal arch structure of toroidal elements with suspended floor and ceiling decks.
Figure 9:
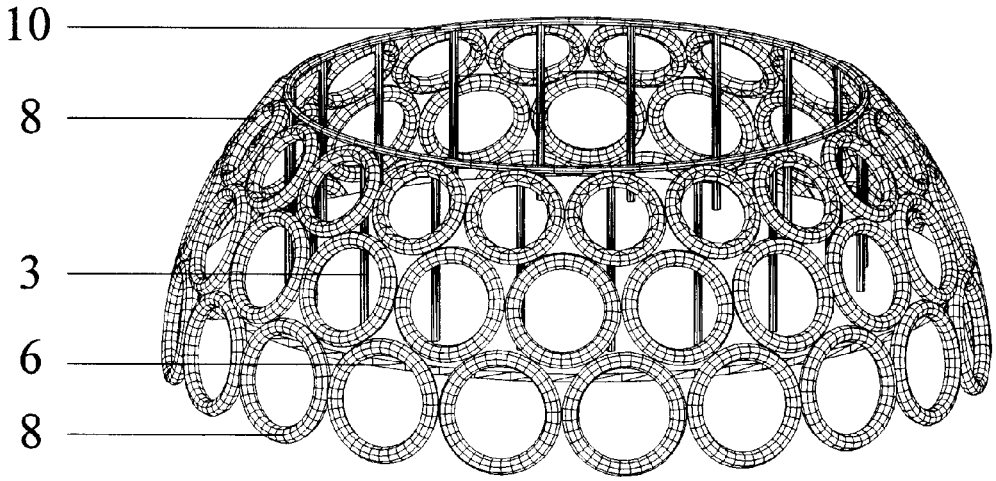
FIG. 9 is a perspective view of the suspended deck structure shown in FIG. 8 without the ceiling deck.
Figure 10:
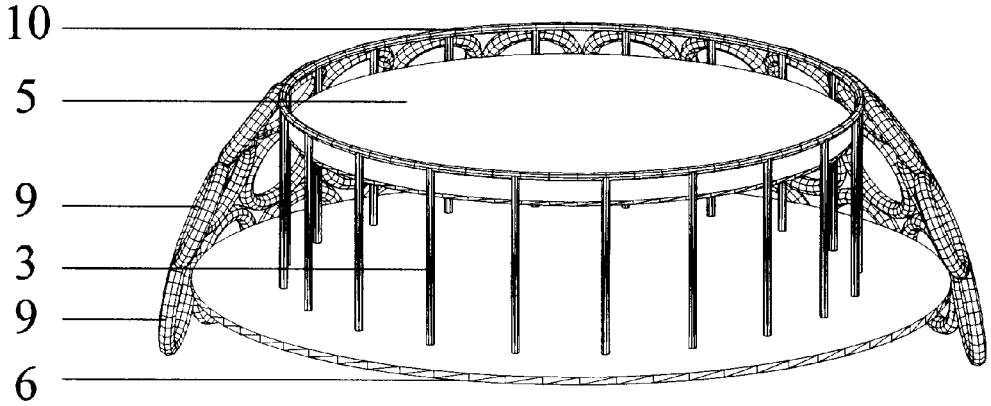
FIG. 10 is a perspective view of the suspended deck structure shown in FIG. 8 with toroidal elements removed from one side to reveal the floor/deck suspension within.

For suspended deck structures that would provide more resistance to damage resulting from earth movement, the preferred embodiment of the suspended deck structure is shown in FIGS. 8–9, in which stacked horizontal arches 8—a horizontal arch 8 being composed of one of the horizontal layers of connected toroidal members 9 shown in FIG. 10—form a framework, and the tension elements suspending the decks 5, 6 are connected to the topmost horizontal arch 8, or a toroidal beam 10 connected to the top of the horizontal arch 8 stack, as shown in FIGS. 8–10. (The horizontal arch is the subject of a United States Patent Application filed on May 10, 1999.) The structural coherence of the horizontal arches 8, together with being connected in an interleaved stack, make the entire framework structurally independent of foundational support from 65 per cent of the foundation points where at least every third foundation point is supported. Such a framework for this preferred embodiment of the suspended deck structure is contemplated in U.S. patent application Ser. No. 09/276,665, Structural System of Toroidal Elements and Method of Construction Therewith, made by the present applicant. Such toroidal members can have the compression strength and resilience of torsion structures contemplated in U.S. patent application Ser. No. 09/276,666, Structural System of Torsion Elements and Method of Construction Therewith, which also contemplates such a framework, and also is made by the present applicant. The teachings of said patent applications are hereby incorporated by reference for this purpose.

Figure 11:
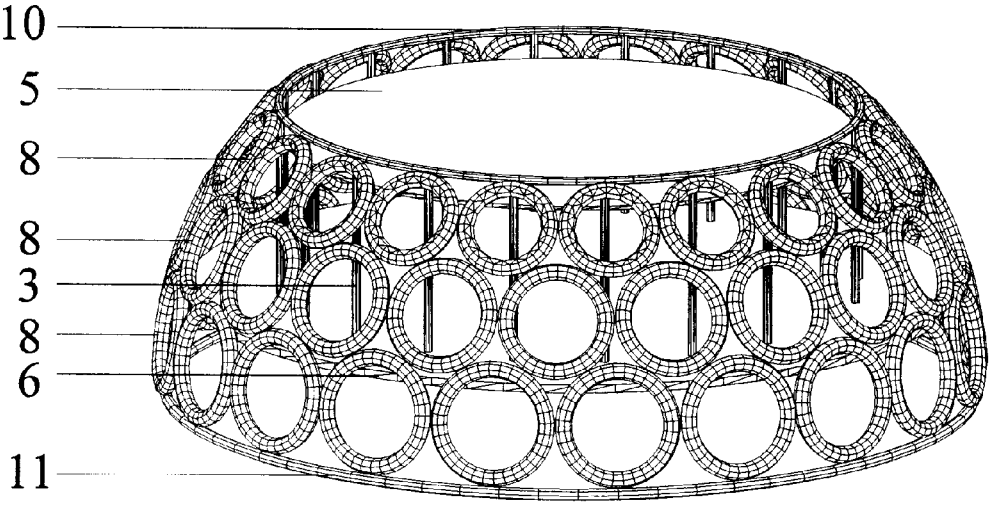
FIG. 11 is a perspective view of the suspended deck structure shown in FIG. 7 with an integrated toroidal foundation element.
Figure 12:
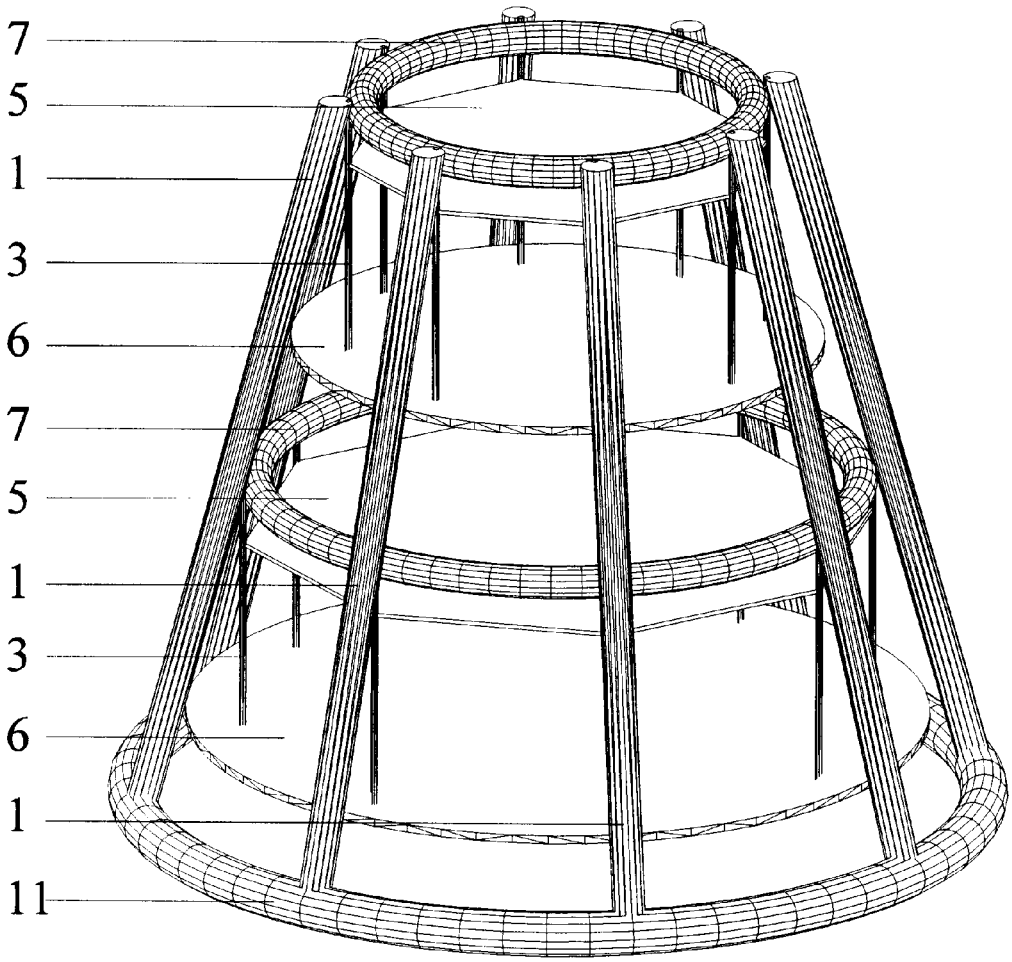
FIG. 12. is a perspective view of the suspended deck structure shown in FIG. 8 with an integrated toroidal foundation element.

The resistance to damage from earth movement of the structures shown in FIGS. 7–10 may be enhanced by means of the known method of ball bearing support of Foundation bearing points of the structure at the foundation level, or by integrating the foundation with the structure, such as with the addition of a foundation level toroidal base 11 as shown in FIGS. 11 and 12.

Figure 13:
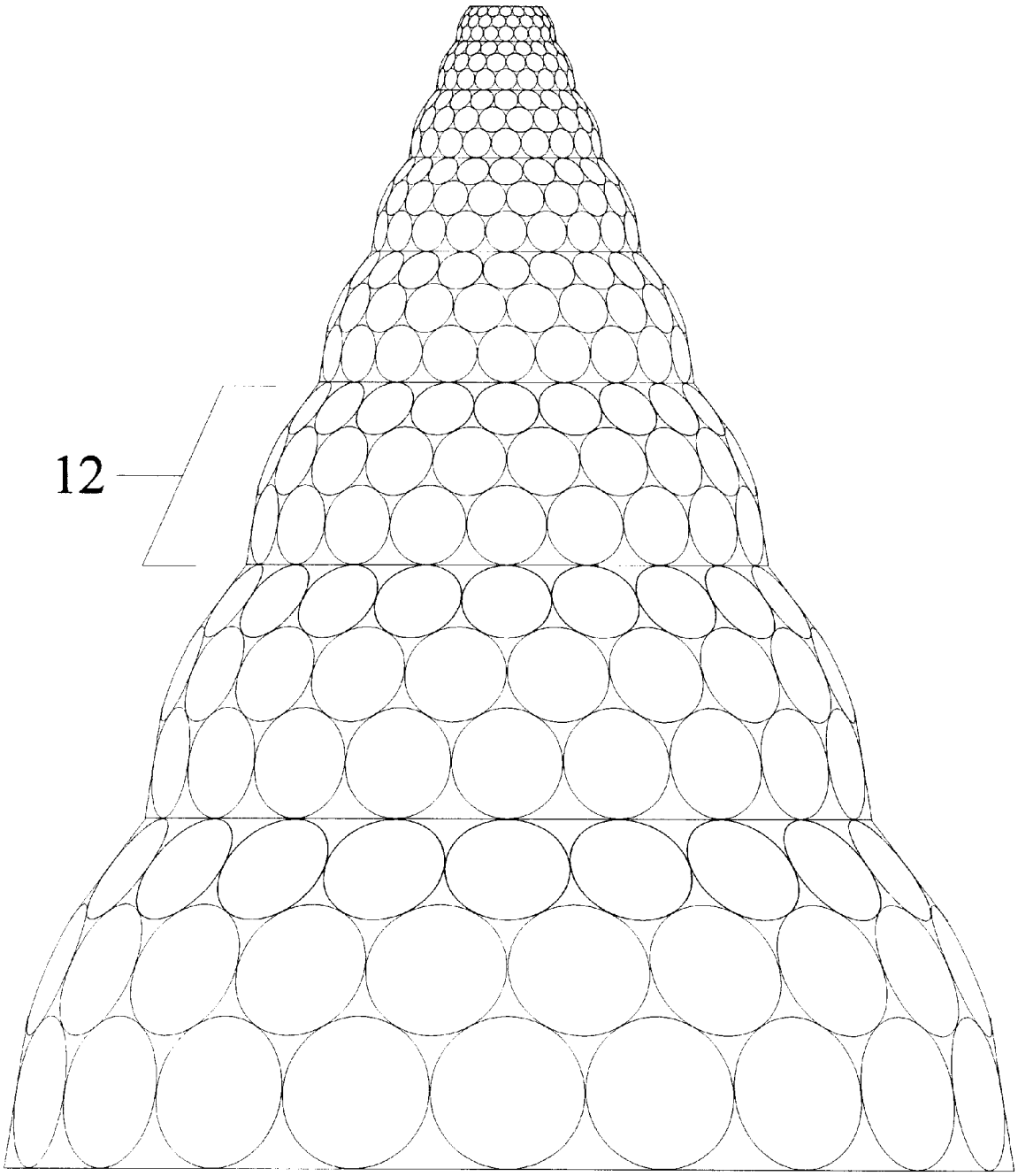
FIG. 13 is a schematic side view of the stacking of 8 of the structures shown in FIGS. 8 and 12 to form a tower/building.

The invention contemplates multistory structures, not only as shown in FIGS. 1, 3, 5, 6, and 7, but also by stacking the structures 12 in FIGS. 8–11 as shown schematically in FIG. 13.

While the invention has been disclosed in connection with a preferred embodiment, it will be understood that there is no intention to limit the invention to the particular embodiment shown, but it is intended to cover the various alternative and equivalent constructions included within the spirit and scope of the appended claims.

What I claim as my invention is:

1. A suspended deck structure comprising:

a load bearing framework for bearing a vertically downward load;

one or more decks; and a means for suspending said one or more decks from the framework, so that said one or more decks are suspended within the volume bounded by the framework;

so that said one or more decks are not in direct contact with the framework;

so that said one or more decks can move relative to the framework; and so that movement of said one or more decks suspended within the framework is constrained by the framework to remain within the volume bounded by the framework.

2. The suspended deck structure of claim 1 wherein the means for suspending said one or more decks comprises three or more suspending tension elements which are arranged so that three of said three or more suspending tension elements are attached to each of said one or more decks in the position of the vertices of a triangle in the general plane of each of said one or more decks.

3. The suspended deck structure of claim 1 wherein said one or more decks can move horizontally in all directions relative to the framework.

4. The suspended deck structure of claim 1, further comprising a means for damping the motion of said one or more decks relative to the framework.

5. The suspended deck structure of claim 4 wherein the means for damping the motion of said one or more decks is located between said one or more decks and the framework.

6. The suspended deck structure of claim 1 wherein said means for suspending said one or more decks includes ball-joints.

7. A suspended deck structure comprising:

a load bearing framework for bearing a vertically downward load;

one or more decks defining a respective stationary plane; and three or more suspending tension elements for each of said one or more decks suspended from the framework which are arranged so that three of said three or more suspending tension elements are attached to said each of said one or more decks in the position of the vertices of a triangle in the general plane of said each of said one or more decks, so that said one or more decks are suspended within the volume bounded by the framework;

so that said one or more decks are adapted to move parallel to the stationary plane relative to the framework; and so that movement of said one or more decks suspended within the framework is constrained by the framework to remain within the volume bounded by the framework.

8. The suspended deck structure of claim 7 wherein said one or more decks are suspended from said framework so that said one or more decks are not in direct contact with the framework.

9. The suspended deck structure of claim 7 wherein said one or more decks can move horizontally in all directions relative to the framework.

10. The suspended deck structure of claim 7, further comprising a means for damping the motion of said one or more decks relative to the framework.

11. The suspended deck structure of claim 10 wherein the means for damping the motion of said one or more decks is located between said one or more decks and the framework.

12. The suspended deck structure of claim 7 wherein said means for suspending said one or more decks includes ball-joints.

13. A suspended deck structure comprising:

a load bearing framework for bearing a vertically downward load;

one or more decks defining a respective stationary plane; and a means for suspending said one or more decks from the framework, so that said one or more decks are suspended within the volume bounded by the framework;

so that said one or more decks are adapted to move parallel to the stationary plane relative to the framework; and so that movement of said one or more decks suspended within the framework is constrained by the framework to remain within the volume bounded by the framework.

14. The suspended deck structure of claim 13 wherein said one or more decks are suspended from said framework so that said one or more decks are not in direct contact with the framework.

15. The suspended deck structure of claim 13 wherein said one or more decks can move horizontally in all directions relative to the framework.

16. The suspended deck structure of claim 13, further comprising a means for damping the motion of said one or more decks relative to the framework.

17. The suspended deck structure of claim 16 wherein the means for damping the motion of said one or more decks is located between said one or more decks and the framework.

18. The suspended deck structure of claim 13 wherein the means for suspending said one or more decks includes ball-joints.

19. The suspended deck structure of claim 13 wherein the means for suspending said one or more decks is such that when said one or more decks are moved relative to the framework from which they are suspended, said one or more decks remain parallel to their original suspended position at rest relative to the framework.

* * * * *